US009057201B2

(12) United States Patent
Milligan et al.

(10) Patent No.: US 9,057,201 B2
(45) Date of Patent: Jun. 16, 2015

(54) INTERIOR WALL SYSTEM

(71) Applicant: Teknion Limited, Toronto (CA)

(72) Inventors: Geoffrey Andrew Scott Milligan, Toronto (CA); Zoran Baic, Mississauga (CA); Sean Adrian Conroy, Toronto (CA); Paul Frederick Kruger, Toronto (CA); Slava Dushkin, Richmond Hill (CA); Paul Kai Chit So, Thornhill (CA); Dan Cristian Cernatescu, Vaughan (CA)

(73) Assignee: TEKNION LIMITED, Toronto (CA)

( * ) Notice: Subject to any disclaimer, the term of this patent is extended or adjusted under 35 U.S.C. 154(b) by 151 days.

(21) Appl. No.: 13/742,737

(22) Filed: Jan. 16, 2013

(65) Prior Publication Data

US 2013/0192148 A1 Aug. 1, 2013

Related U.S. Application Data

(60) Provisional application No. 61/592,235, filed on Jan. 30, 2012.

(51) Int. Cl.

| | |
|---|---|
| ***A47F 10/00*** | (2006.01) |
| ***E04F 21/18*** | (2006.01) |
| ***E04B 2/00*** | (2006.01) |
| ***E06B 3/54*** | (2006.01) |
| ***E04B 2/74*** | (2006.01) |
| *E06B 3/58* | (2006.01) |

(52) U.S. Cl.

CPC ..... *E04F 21/1877* (2013.01); *E04B 2/00* (2013.01); *E06B 3/54* (2013.01); *E06B 3/5828* (2013.01); *E04B 2/7401* (2013.01); *E04B 2002/7492* (2013.01)

(58) Field of Classification Search

USPC ..... 52/36.1, 64, 126.3, 126.4, 238.1, 241, 52/243.1, 481.2

See application file for complete search history.

(56) References Cited

U.S. PATENT DOCUMENTS

| | | | | |
|---|---|---|---|---|
| 3,696,569 | A * | 10/1972 | Didry | 52/126.4 |
| 3,830,027 | A * | 8/1974 | Paisley et al. | 52/211 |
| 4,037,380 | A * | 7/1977 | Pollock | 52/475.1 |
| 4,086,734 | A * | 5/1978 | Hayashi | 52/126.4 |
| 7,814,711 | B2 | 10/2010 | Milligan et al. | |
| 7,861,474 | B2 * | 1/2011 | Houle et al. | 52/242 |
| 7,958,684 | B2 * | 6/2011 | Kleege | 52/243.1 |

* cited by examiner

*Primary Examiner* — Jeanette E Chapman
*Assistant Examiner* — James Buckle, Jr.
(74) *Attorney, Agent, or Firm* — Bereskin & Parr LLP/S.E.N.C.R.L., s.r.l.

(57) ABSTRACT

A leveling assembly for an interior wall system includes an elongate floor channel secured to the floor, a floor rail longitudinally disposed within the floor channel for supporting the wall panel, and levelers positioned along the floor channel. The levelers each include a base resting on the floor channel, a threaded rod projecting upwardly from the base, an outer threaded sleeve capable of telescoping movement over the threaded rod, and a threaded nut secured in an opening defined in a bottom surface of the floor rail. The threaded nut supports the floor rail. The levelers vertically space apart the floor rail from the floor channel.

30 Claims, 7 Drawing Sheets

INTERIOR WALL SYSTEM

PRIOR APPLICATION

This application claims the benefit of U.S. Provisional Patent Application No. 61/592,235 filed on Jan. 30, 2012 entitled "INTERIOR WALL SYSTEM", which is incorporated by reference herein in its entirety.

FIELD

The invention relates generally to interior wall systems for buildings.

INTRODUCTION

Interior wall systems are well known. Such systems are commonly used, for example, to finish the open areas in office buildings. One type of interior wall system is a modular partition wall system which is composed of a number of wall panels in a side-by-side arrangement. An example of such a system is described in Applicant's U.S. Pat. No. 7,814,711, which is incorporated by reference herein in its entirety.

The above interior wall systems are typically constructed using glass wall panels (whether transparent, translucent, or opaque) and have become increasingly popular due to their aesthetic, environmental and workplace planning qualities. Such wall systems are commonly referred to as "seamless glass walls" or "butt glazed walls".

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect of the teachings described herein, a leveling assembly for leveling a bottom edge of a panel for an interior wall system is provided. The interior wall system is configured for installation in a building having a floor. The leveling assembly comprises:

an elongate floor channel operatively secured to the floor;

a floor rail longitudinally disposed within the floor channel, wherein the floor rail is adapted to support the wall panel; and a plurality of levelers positioned along the floor channel, wherein at least one of the plurality of levelers comprises:

a base adapted to rest on the floor channel;

a threaded rod projecting upwardly from the base;

an outer threaded sleeve adapted to threadably engage the threaded rod, wherein the threaded sleeve is adapted for telescoping movement over the threaded rod; and a threaded nut secured in an opening defined in a bottom surface of the floor rail, the threaded nut adapted to support the floor rail, wherein the threaded nut is prevented from rotating in the opening, wherein the threaded nut is adapted to threadably engage the sleeve;

wherein the plurality of levelers are adapted to vertically space apart the floor rail from the floor channel, wherein the plurality of levelers are adapted to substantially horizontally level the floor rail.

According to another broad aspect of the teachings described herein, a top assembly of an interior wall system having a wall panel is provided. The interior wall system is configured for installation in a building having a ceiling. The top assembly comprises:

an elongate ceiling channel operatively secured to the ceiling, the ceiling channel comprising:

a pair of planar downwardly depending side edges, and a substantially horizontal planar portion located between the side edges, an elongate ceiling bracket located in the ceiling channel, the ceiling bracket comprising a planar upper surface; and an elongate ceiling rail connected to a bottom surface of the ceiling bracket, the ceiling rail defining a longitudinal gap in a bottom portion of the ceiling rail, the gap adapted to receive a top edge of the wall panel;

wherein the ceiling bracket is configurable between a first and second orientation, wherein, in the first orientation of the ceiling bracket, the planar upper surface of ceiling bracket abuts against the planar portion of the ceiling channel, wherein in the second orientation, the planar upper surface of the ceiling bracket is spaced apart from the planar portion of the ceiling channel.

DRAWINGS

DETAILED DESCRIPTION

Figure 1:
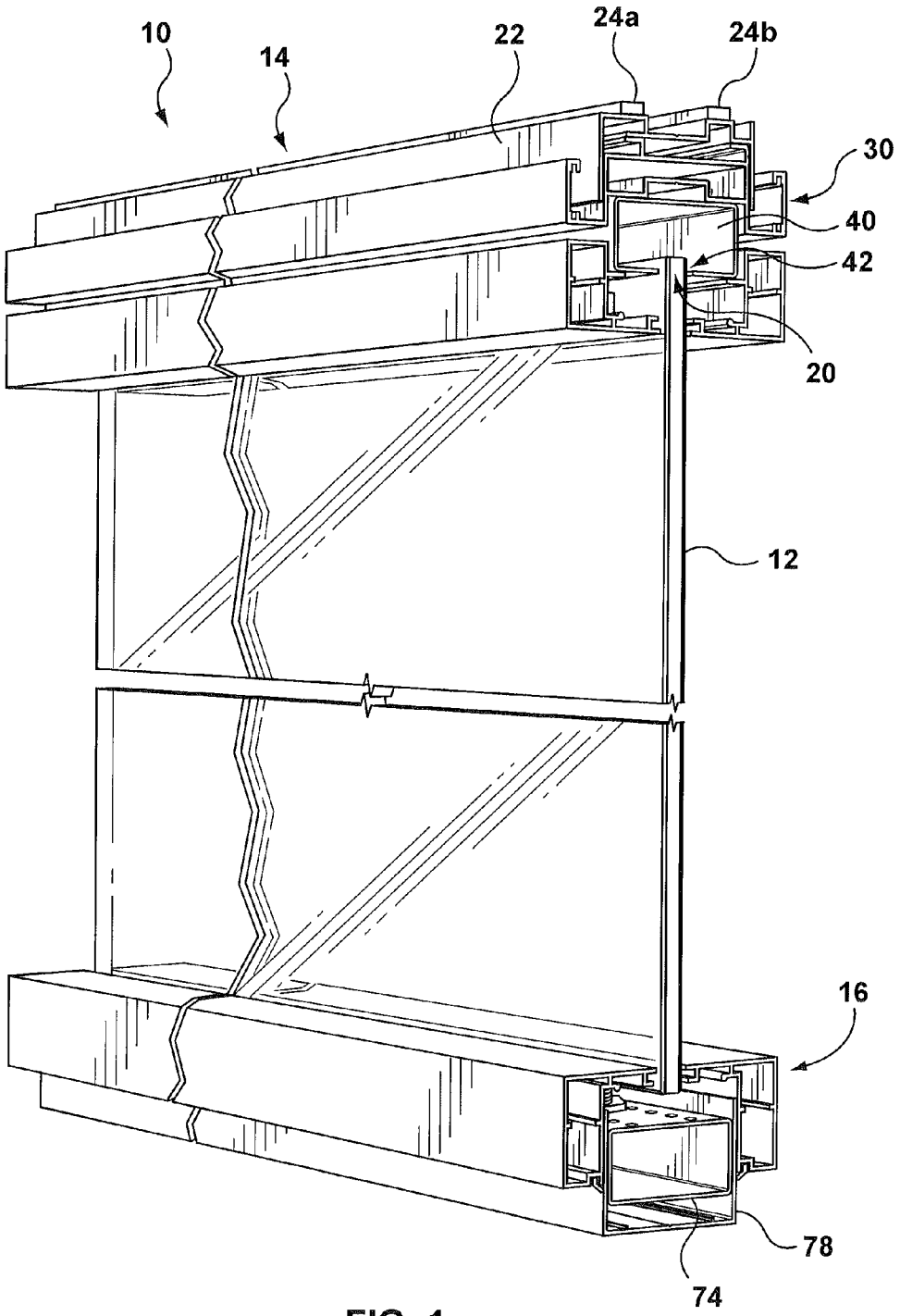
FIG. 1 is a perspective view of an embodiment of the interior wall system.

FIG. 1 shows a portion of an interior wall system 10 according to a first embodiment of the present invention. The portion of the interior wall system 10 illustrated in FIG. 1 includes a glass wall panel 12. The upper edge of the glass wall panel 12 is secured within a top assembly 14 which secures the glass wall system to the ceiling (not shown). The lower edge of the glass wall panel 12 is secured within a floor leveling assembly 16. While only one glass wall panel is illustrated for convenience, it will be understood by those skilled in the art that the interior wall system 10 may be constructed of any suitable number of glass wall panels. In an interior wall system consisting of more than one glass wall panel (shown in FIGS. 6 and 7), the panels may be joined to each other at their vertical edges by a transparent adhesive material, such as transparent acrylic double-sided tape commercially available from 3M Corporation.

It will be understood by those skilled in the art that it is not essential that the wall panels be made of glass. The wall panels may be made from any other suitable material, whether transparent, translucent, or opaque.

Figure 2:
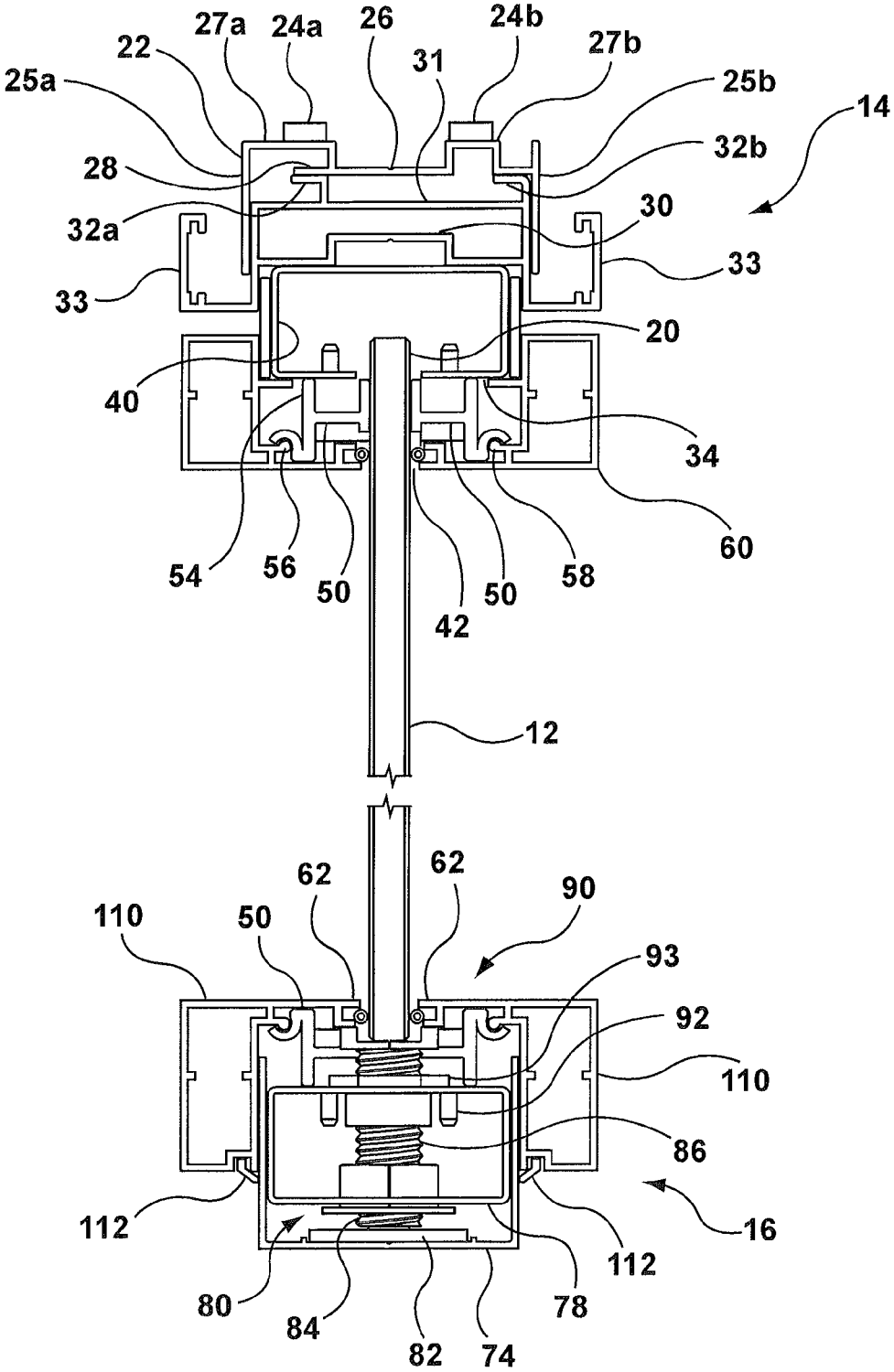
FIG. 2 is an elevation view of the interior wall system of FIG. 1.

Referring to FIGS. 1 and 2, the wall panel 12 is secured at its upper end 20 to a top assembly 14. The top assembly 14 includes a ceiling channel 22 secured to the ceiling at any suitable interval by any suitable fasteners (not shown). The type of fastener used depends on the type of ceiling. For longer runs, several ceiling channels 22 may be connected in series. Ceiling gaskets 24*a*, 24*b* may be provided between the ceiling channel 22 and ceiling for improved sound attenuation. Preferably, the ceiling gaskets 24*a*, 24*b* are made of foam or any other suitable malleable sound absorbing material.

Continuing to refer to FIGS. 1 and 2, the ceiling channel 22 includes a pair of downwardly depending side edges 25*a*, 25*b* connected by a generally planar portion 26 extending between the side edges. A pair of spaced-apart longitudinal slots 27*a*, 27*b* are provided in the planar portion 26. Each slot may be located at a different distance from the corresponding side edge. Preferably, slot 27*a* is located at side edge 25*a*, and slot 27*b* is offset from side edge 25*b*. The slot 27*a* includes a transversely extending ledge 28 covering a portion of the slot opening.

A ceiling bracket 30 is located within the ceiling channel 22 and is secured to the ceiling channel at any suitable interval by any suitable fasteners (not shown). The ceiling bracket has a planar upper surface 31. A pair of longitudinally extending shoulders 32*a*, 32*b* protrude upwardly from the upper surface 31. The shoulders have an angled or L-shaped cross-section. A skirt 33 is provided on either side of the ceiling bracket 30 to provide an aesthetically pleasing rectilinear appearance. The ceiling bracket may be positioned in one of two configurations shown in FIGS. 3A and 3B, respectively.

Figure 3A:
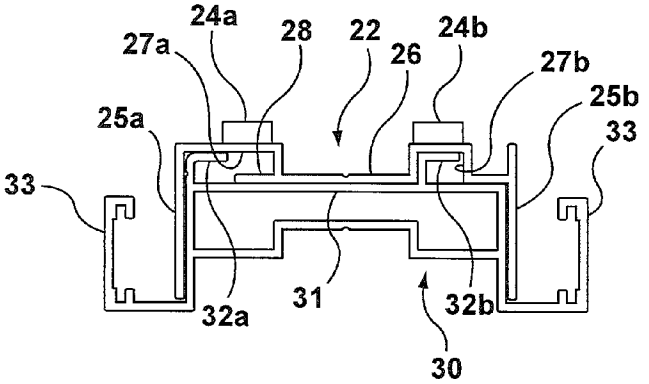
FIGS. 3A-3D are partial elevation views of the interior wall system of FIG. 1 showing a portion of the top assembly in four different configurations.

FIG. 3A shows the ceiling bracket 30 in the first configuration. The shoulders 32*a*, 32*b* of the ceiling bracket abut against the slots 27*a*, 27*b*, which permits the planar upper surface 31 of the ceiling bracket 30 to abut against the planar portion 26 of the ceiling channel 22. The first configuration shown in FIG. 3A enables installation of the top assembly 14 with the smallest distance between the top edge of the wall panel 12 and the ceiling. In one embodiment, the configuration of FIG. 3A permits installation when the distance is about 0.25 inches less than the optimal distance. As used herein, the "optimal distance" is the vertical distance between an edge of the wall panel and the floor or ceiling (as the case may be) which is specified in the design drawings for the wall system according to an embodiment of the present invention.

Figure 3B:
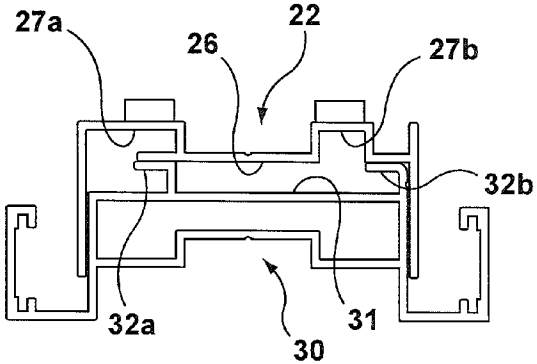

In order to configure the ceiling bracket 30 in the second configuration shown in FIG. 3B, the bracket is rotated 180 degrees in a horizontal plane. In this configuration, the shoulders 32*a*, 32*b* of the ceiling bracket 30 are out of alignment with the slots 27*a*, 27*b* of the ceiling channel 22, causing the shoulders 32*a*, 32*b* to abut against the planar portion 26 of the ceiling channel. This in turn causes the upper surface 31 of the ceiling bracket 30 to be spaced apart from the planar portion 26 of the ceiling channel 22. The configuration of FIG. 3B may be selected when the distance between the top edge of the wall panel and the ceiling is greater than can be covered by the configuration of FIG. 3A. Preferably, this configuration is used when the distance matches the optimal distance.

Figure 3C:
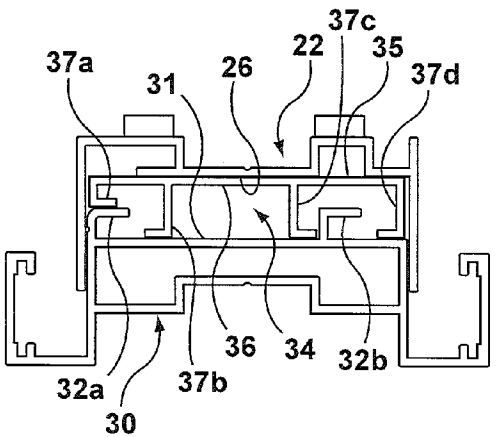
Figure 3D:
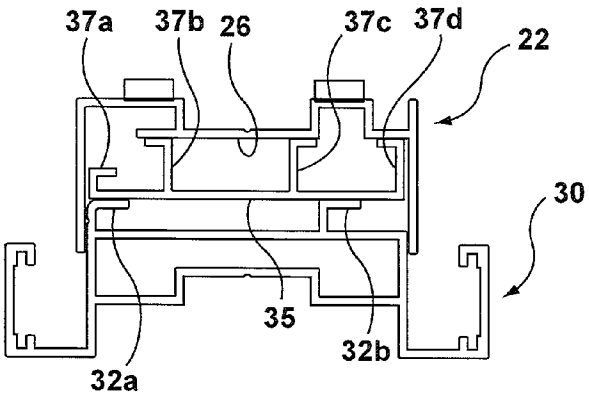

FIGS. 3C and 3D show a removable spacer 34 which may be located between the ceiling channel 22 and ceiling bracket 30. The spacer 34 includes a first planar surface 35 and a second opposing surface 36. A number of longitudinally extending protrusions 37*a*, 37*b*, 37*c*, and 37*d* project outwardly from the second surface 36. The protrusions may have an angled or L-shaped cross-sectional shape similar to the shoulders 32*a*, 32*b*. The spacer may be located in one of two positions shown in FIGS. 3C and 3D, respectively. When the spacer 34 is used, the ceiling bracket 30 is preferably in the first configuration.

Referring to FIG. 3C, the spacer 34 is located with the first planar surface 35 facing upwardly toward the ceiling and the protrusions 37*a-d* extending downwardly. The first planar surface 35 abuts against the planar portion 26 of the ceiling channel 22. The protrusion 37*a* abuts against shoulder 32*a*. The protrusions 37*b-d* abut against the upper surface 31 of the ceiling bracket 30. The spacer position of FIG. 3C may be selected when the distance between the top edge of the wall panel and the ceiling is greater than can be covered by the configuration of FIG. 3B. In one exemplary embodiment, this position is used when the distance exceeds the optimal distance by about 0.25 inches.

In order to change the position of the spacer 34 to the second position shown in FIG. 3D, the spacer is rotated 180 degrees in the vertical plane and 180 degrees in the horizontal plane. In this position, the first planar surface 35 faces downwardly and the protrusions 37*a-d* extend upwardly. The first planar surface 35 abuts the shoulders 32*a,b* of the ceiling bracket 30, and the protrusions 37*b-d* abut against the planar portion 26 of the ceiling channel 22. The spacer position of FIG. 3D may be selected when the distance between the top edge of the wall panel and the ceiling is greater than can be covered by the configuration of FIG. 3C. Preferably, this position is used when the distance exceeds the optimal distance by about 0.5 inches.

Referring again to FIGS. 1 and 2, a ceiling rail 40 is located within a bottom portion of the ceiling bracket 30. Ceiling rail 40 is secured to ceiling bracket 30 also by any suitable fasteners (not shown) at any suitable interval. A gap 42 is provided in a bottom surface of the ceiling rail 40 to receive the upper edge 20 of the panel 12.

Figure 7:
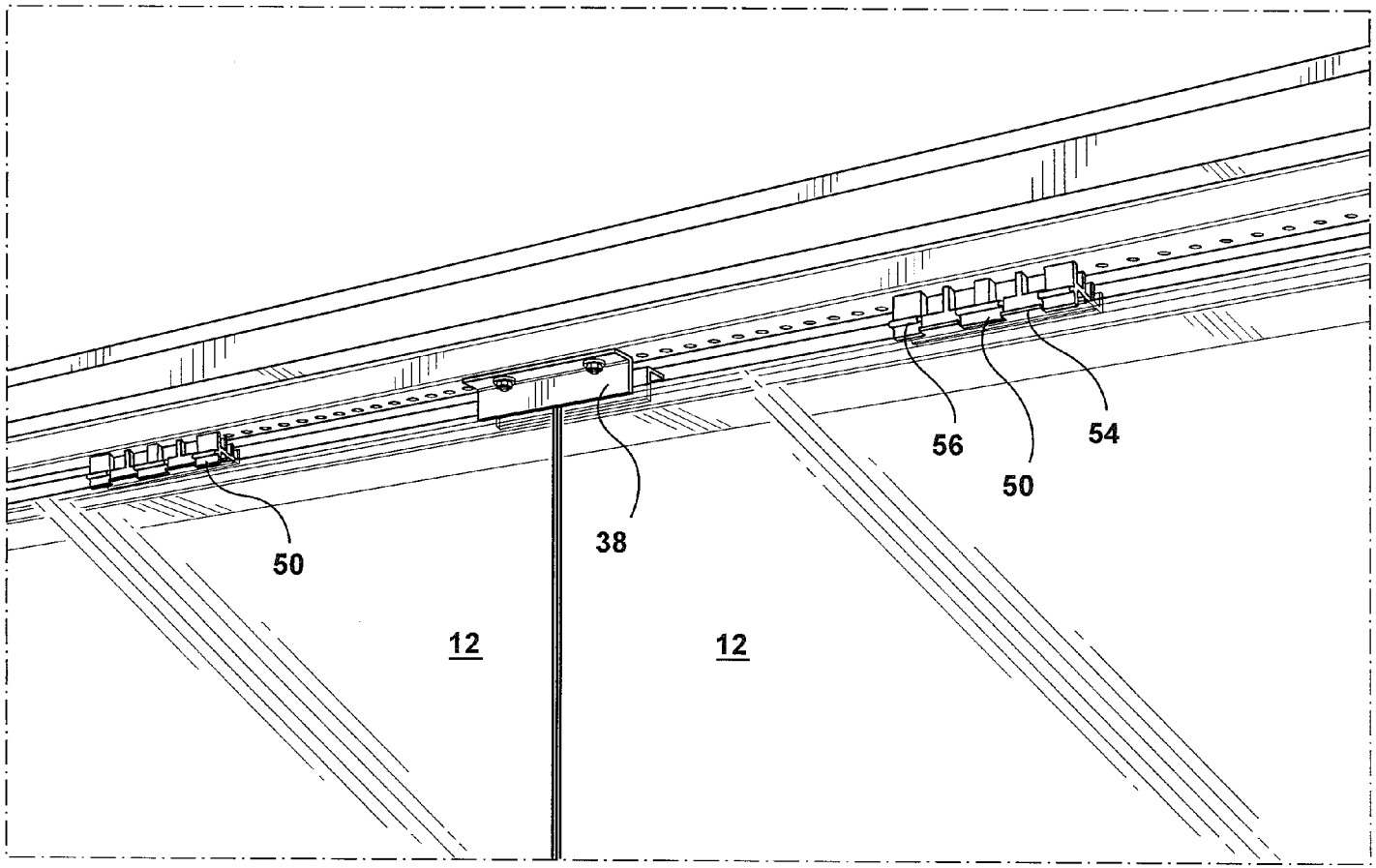
FIG. 7 is a partial perspective view of a top portion of the interior wall system of FIG. 1 showing multiple glass panels.

Referring to FIG. 7, elbow brackets 38 may be located at the joints of adjacent glass panels 12. Preferably, a pair of elbow brackets 38 are positioned facing each other on either side the panels at each joint. Each elbow bracket includes a vertical portion which abuts against the panels 12 and a horizontal portion which is secured by fasteners to the ceiling rail 40. The elbow brackets assist with retaining the panels in the gap 42 and stabilizing the panels.

Referring now to FIGS. 2 and 7, clips 50 are also connected to the ceiling rail 40 by fasteners (not shown) at any suitable interval. Preferably, the clips 50 are also positioned in facing pairs. Each of the clips 50 includes a vertical wall portion 54 to assist with retaining and stabilizing the panels 12. Ribs are provided to add rigidity to the vertical portion 54 of the clips 50. Each of the clips include flexible lips 56 into which snaps a flexible ridge 58 of a ceiling trim member 60 (shown in FIG. 2). Accordingly, the clips 50 may perform a dual function of stabilizing the panels and securing the ceiling trim member 60. Trim gaskets (not shown) may be provided to improve sound attenuation.

The ceiling trim member 60 may be an aluminum extrusion which provides an esthetically pleasing appearance and hides parts of ceiling retaining assembly 14.

Figure 4:
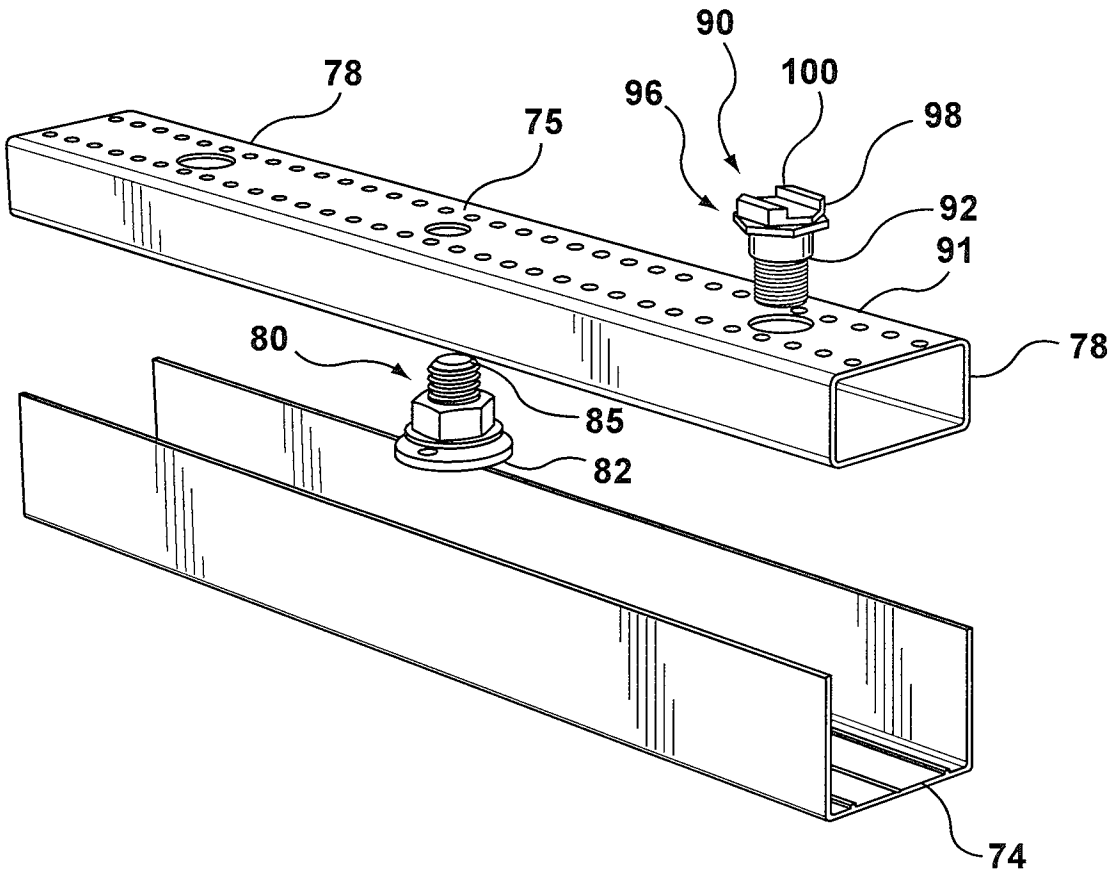
FIG. 4 is an exploded perspective view showing a floor assembly of the interior wall system of FIG. 1.

Continuing to refer to FIGS. 1 and 2, the floor leveling assembly 16 includes a preferably U-shaped elongate floor channel 74 which is preferably secured to the floor by fasteners (not shown) located at any suitable interval. A floor rail 78 is disposed within the floor channel 74. Preferably, the floor rail 78 is an elongate tube having a rectangular cross section. As best shown in FIG. 4, a number of preferably hexagonal-shaped holes 75 are cut out in the top and bottom surfaces of the floor rail 78, as described in more detail below.

Figure 5A:
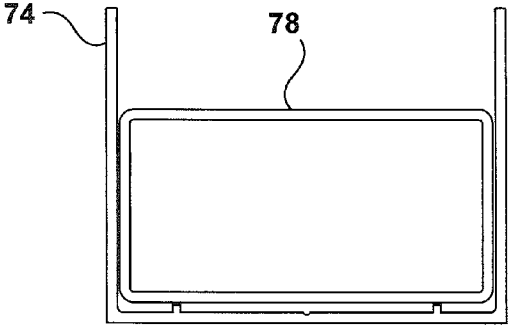
FIGS. 5A-5D are partial elevation views of the interior wall system of FIG. 1 showing the floor assembly at four different heights.
Figure 5B:
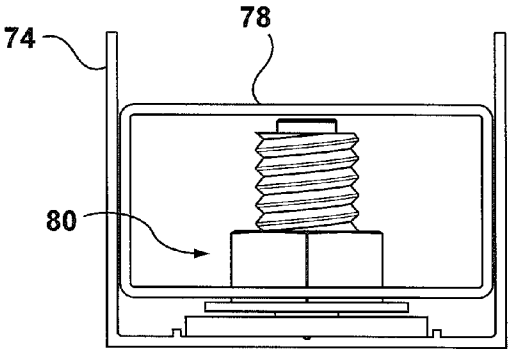
Figure 5C:
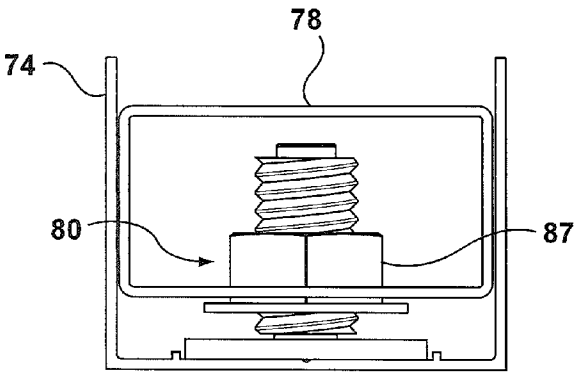
Figure 5D:
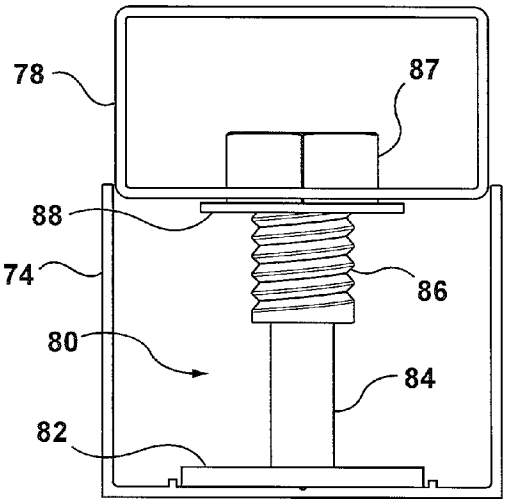

Referring to now to FIGS. 2, 4 and 5D, the floor rail 78 is supported by levelers 80 positioned at intervals along the floor channel 74. Each leveler 80 includes a base 82 which rests on the floor channel 74. As best shown in FIG. 5D, a threaded rod 84 projects upwardly from the base 82 (the threading of the rod is omitted from FIG. 5D for clarity). An axial opening 85

(best shown in FIG. 4) is provided in top of the threaded rod 84 to permit turning of the threaded rod by an Allen key or the like. A threaded sleeve 86 is connected to the threaded rod 84 and is capable of vertical telescoping movement along the threaded rod when the threaded rod is turned. A preferably hexagonal nut 87 engages the threaded sleeve. The nut 87 is capable of movement along the threaded sleeve 86. The nut 87 includes a preferably integral flange 88 on which the floor rail 78 is supported.

FIGS. 5A-D show the range of leveling available using the levelers 80 according to an exemplary embodiment. FIG. 5A shows the floor channel 74 and floor rail 78 with the levelers 80 removed. This configuration is preferably used when the distance between the bottom edge of the panel and the floor is about 0.25 inches less than the optimal distance. FIG. 5B shows the floor channel 74 and floor 78 with the levelers 80 present and the nut 87 set to the lowest height. This configuration is preferably used when the distance is about 0.15 inches less than the optimal distance. FIG. 5C shows the nut 87 of the leveler 80 raised slightly. This configuration is preferably used when the distance is about equal to the optimal distance and no leveling is required. FIG. 5D shows the nut 87 of the leveler 80 extended at its maximum height where the sleeve 86 is at its highest point on the rod 84, and the nut 87 is at its highest point on the sleeve 86. This configuration provides the greatest leveling distance when the distance between the bottom edge of the panel and the floor exceeds the optimal distance by about 1.38 inches. It will be understood by those skilled in the art that the nut 87 can be set at any suitable height between the heights shown in FIGS. 5B and 5D.

Figure 6:
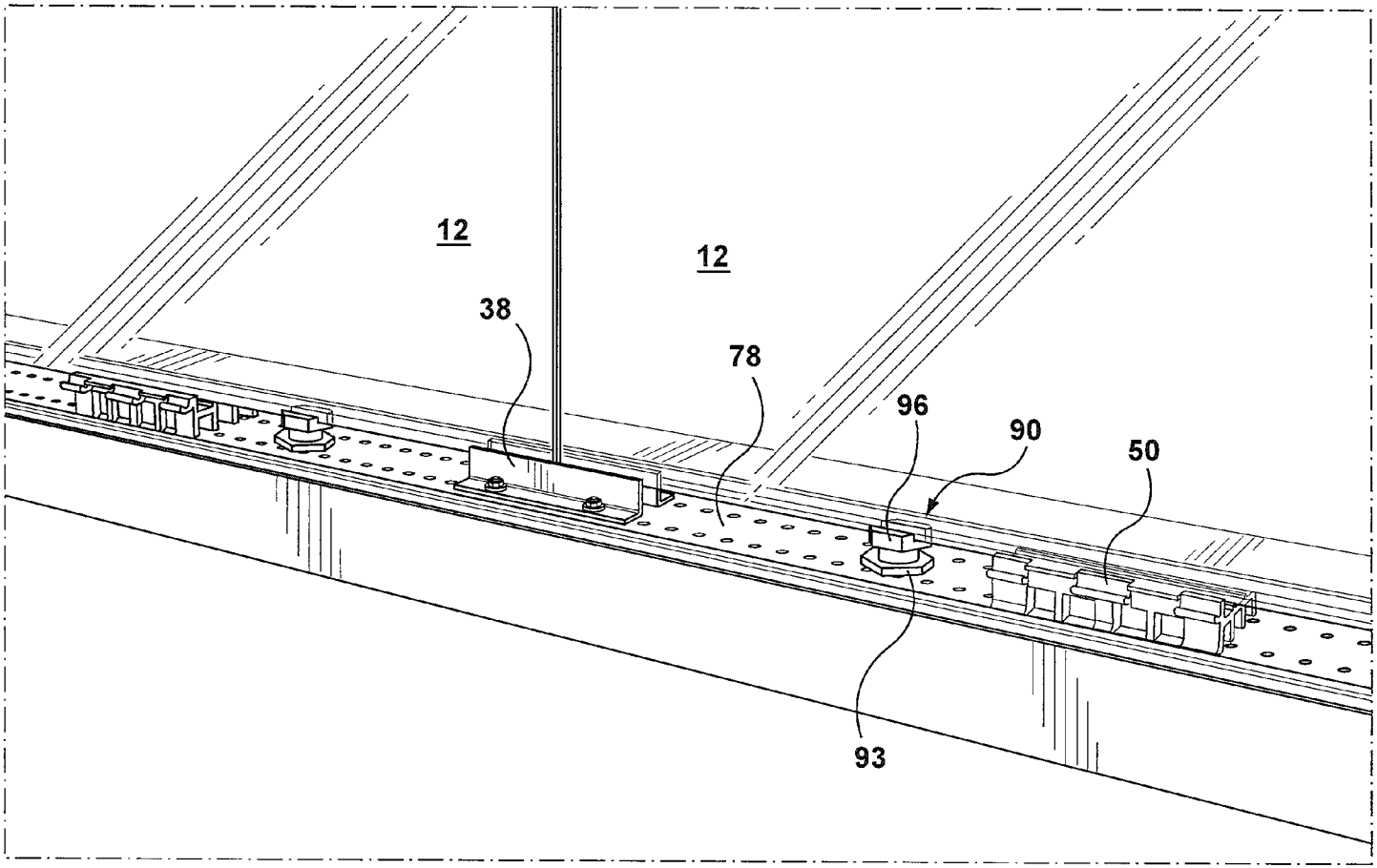
FIG. 6 is a partial perspective view of a bottom portion of the interior wall system of FIG. 1 showing multiple glass panels.

Referring to FIGS. 2, 4 and 6, panel supports 90 are mounted on the top surface of the floor rail 78. Each panel support 90 includes a housing 92 located within an opening 91 in the top surface of the floor rail 78. The housing 92 includes a preferably hexagonal-shaped flange 93 which can be turned with a wrench (not shown) or the like. The flange 93 of housing 92 sits on top of the floor rail 78 and is capable of rotating relative to floor rail 78. A threaded opening (not shown) is provided in the housing 92 which receives a bolt 96. The bolt 96 includes a hat 98 with a channel 100 which receives the bottom edge of the glass panel 12. The panel supports 90 are capable of providing a fine leveling adjustment for the panels 12, as described in more detail below. This fine leveling facilitates close alignment of the vertical edges of the panels 12 in order that the panels can be joined with the adhesive tape described above.

Referring now to FIGS. 2 and 6, elbow brackets 38 and clips 50 are also provided in the floor leveling assembly 16 and are secured to the floor rail 78 in a similar fashion as described for the top assembly 14. An interior ridge of a floor trim member 110 snaps into the clips 50 connected to the floor rail 78 in a similar fashion as described for the top assembly 14. Like the ceiling trim member 60, the floor trim member 110 is preferably an aluminum extrusion which hides the floor leveling assembly 16 and provides an esthetically pleasing appearance.

Referring to FIG. 2, trim gaskets 62 are also provided between the floor trim member 110 and the panels 12. A floor gasket 112 is secured to the bottom of the floor trim member 110 and extends between the floor trim member and the floor channel 74. The floor gasket 112 also provides improved sound attenuation.

The operation of the exemplary embodiment of the invention will now be described.

Referring to FIG. 2, the top assembly 14 and the floor leveling assembly 16 are secured to their desired locations in the ceiling and floor, respectively. The ceiling channel 22 is secured to ceiling by fasteners. If desirable, the spacer 34 is positioned in the ceiling bracket 30 in one of the positions illustrated in FIGS. 3C and 3D. If, given the measured distance of the location of the top edge 20 of the panel 12 and the ceiling, the spacer 34 is not desirable the ceiling bracket 30 may be used alone in one of the configurations illustrated in FIGS. 3A and 3B. With or without the spacer 34, the ceiling bracket 30 is secured to the ceiling channel 22 by fasteners. The ceiling rail 40 is then secured to the ceiling bracket 30 in the same manner.

The floor channel 74 is secured to the floor by fasteners. If the measured distance between the location of the bottom edge of the panel 12 and the floor permits, the levelers 80 are then located within the hex-shaped holes 75 in the floor rail 78. The floor rail 78 and levelers 80 are then placed in the floor channel 74. The vertical distance between the floor rail 78 and floor channel 74 is adjusted by turning the threaded rod 84 in nuts 87 using an Allen key (not shown). When the threaded rod 84 is turned, it first extends from the sleeve 86 such that the sleeve engages the top end of the rod. If the threaded rod 84 continues to be turned, the sleeve 86 is then forced to turn, causing the nut 87 to move upward along the sleeve 86. The levelers 80 are adjusted such that, when the floor rail 78 rests on the flange 88 of the nut 87 of each leveler 80, the floor rail 78 is level to the horizontal. Any suitable means, such as a conventional bubble or laser level may be used to guide the leveling of the floor rail 78.

Referring now to FIGS. 2, 4 and 6, the panel supports 90 are then installed into the top of the floor rail 78 and adjusted by turning flange 93 with a wrench (thereby adjusting the height of the bolt 96) to provide fine leveling if necessary. The panels 12 are then lifted into the gap 42 of ceiling rail 40 and then lowered onto panel supports 90. In particular, the panels 12 are fitted in channel 100 of hat 98. If necessary, final fine leveling adjustment may be provided by further turning of the flange 93 to bring the vertical edges of adjacent panels 12 into close alignment in preparation for the vertical edges can be joined by the adhesive tape.

Referring now to FIGS. 2 and 6, the panels 12 are further secured by mounting the clips 50 in both the ceiling and floor assemblies 14, 16, respectively. As additional panels 12 are installed in the same manner as described above, elbow brackets 38 are mounted to the ceiling and floor assemblies 14, 16 at the joint of adjacent panels to secure and align the panels. The panels may be slid along the channels 100 of panel supports 90 to join the vertical edges. The adhesive tape is then applied along the adjacent vertical edges of the panels. Finally, the ceiling trim member 60 and floor trim member 110 are snapped onto the clips 50.

The exemplary embodiment described herein accommodates a variation in floor to ceiling dimensions and provides the advantage of floor leveling with the potential for reducing the number of parts required. In addition, the exemplary system described herein facilitates easy assembly and disassembly, which has several advantages. One advantage is the ability by the owner to disassemble the system and reassemble it in a different building. A second advantage is the system is beneficial for the environment because it can be reused and does not necessarily require disposal if the owner of the system moves to a new building.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims.

The invention claimed is:

1. A leveling assembly for leveling a bottom edge of a panel for an interior wall system, the interior wall system configured for installation in a building having a floor, the assembly comprising:

a) an elongate floor channel operatively secured to the floor;

b) a floor rail longitudinally disposed within the floor channel, wherein the floor rail is adapted to support the wall panel; and c) a plurality of levelers positioned along the floor channel, wherein at least one of the plurality of levelers comprises:

i) a base adapted to rest on the floor channel;

ii) a threaded rod projecting upwardly from the base;

iii) an outer threaded sleeve adapted to threadably engage the threaded rod, wherein the sleeve is adapted for telescoping movement over the threaded rod; and iv) a threaded nut secured in an opening defined in a bottom surface of the floor rail, the threaded nut adapted to support the floor rail, wherein the threaded nut is prevented from rotating in the opening, wherein the threaded nut is adapted to threadably engage the sleeve, wherein the threaded nut is adapted to move along the sleeve;

wherein the plurality of levelers are adapted to vertically space apart the floor rail from the floor channel, wherein the plurality of levelers are adapted to substantially horizontally level the floor rail.

2. The leveling assembly of claim 1, wherein the plurality of levelers are adapted to vary the vertical distance between the floor rail and the floor channel in order to substantially level the floor rail.

3. The leveling assembly of claim 2, wherein a hex-shaped axial opening is defined the distal end of the rod, the hex-shaped axial opening is adapted to be engaged by an Allen key.

4. The leveling assembly of claim 2, further comprising a plurality of panel supports connected to a top surface of the floor rail, wherein the panel supports are adapted to provide a fine leveling adjustment for the wall panel.

5. The leveling assembly of claim 4, wherein at least one of the plurality of panel supports comprises:

a) a housing rotatably mounted in an opening defined in a top surface of the floor rail, the housing having a threaded opening defined therein, the housing having a flange adapted to rest on the top surface; and b) a bolt adapted to threadably engage the threaded opening, the bolt having a hat, the hat defining a channel adapted to receive a bottom edge of the of one of the plurality of wall panels;

wherein the flange is rotatable to adjust the height of the bottom edge in relation to the top surface of the floor rail.

6. The leveling assembly of claim 2, wherein the floor channel is U-shaped.

7. The leveling assembly of claim 6, wherein the floor rail comprises an elongate tube having a generally rectangular cross-section.

8. The leveling assembly of claim 2, further comprising a clip connected to the floor rail, the clip comprising a vertical wall portion adapted to abut against the wall panel.

9. The leveling assembly of claim 8, further comprising a plurality of the clips arranged in pairs positioned in opposed relation to each other, wherein each pair of clips is adapted to receive the wall panel therebetween.

10. The leveling assembly of claim 8, further comprising a floor trim member adapted for connection to the clip.

11. The leveling assembly of claim 10, wherein the floor trim member comprises a longitudinally extending ridge along the interior surface thereof, wherein the at least one clip comprises a resilient lip adapted to snap the ridge of the floor trim member to the clip.

12. The leveling assembly of claim 11, wherein the clip comprises a plurality of ribs extending from the vertical wall portion of the clip.

13. The leveling assembly of claim 12, wherein the vertical wall portion of the clip is adapted to contact the wall panel in order to stabilize the wall panel without bearing the weight of the wall panel.

14. The leveling assembly of claim 13, further comprising at least one elbow bracket secured to the floor rail, the elbow bracket being located at a joint of the wall panel with an adjacent wall panel, wherein the elbow bracket comprises a vertical portion adapted to abut against the wall panel and the adjacent wall panel.

15. The leveling assembly of claim 1, wherein the threaded nut is adapted for movement along the sleeve.

16. The leveling assembly of claim 15, wherein a hole is defined in the floor rail to receive the threaded nut, wherein the threaded nut is prevented from rotating in the hole, the threaded nut comprising a flange, wherein the hole is smaller than the flange, wherein the floor rail rests on the flange.

17. The leveling assembly of claim 16, wherein the hole and the nut have a hexagonal shape.

18. A top assembly of an interior wall system having a wall panel, the interior wall system configured for installation in a building having a ceiling, the assembly comprising:

a) an elongate ceiling channel operatively secured to the ceiling, the ceiling channel comprising:

i) a pair of planar downwardly depending side edges, and ii) a substantially horizontal planar portion located between the side edges, b) an elongate ceiling bracket located in the ceiling channel, the ceiling bracket comprising a planar upper surface; and c) an elongate ceiling rail connected to a bottom surface of the ceiling bracket, the ceiling rail defining a longitudinal gap in a bottom portion of the ceiling rail, the gap adapted to receive a top edge of the wall panel;

wherein the ceiling bracket is configurable between a first and second orientation, wherein, in the first orientation of the ceiling bracket, the planar upper surface of ceiling bracket abuts against the planar portion of the ceiling channel, wherein in the second orientation, the planar upper surface of the ceiling bracket is spaced apart from the planar portion of the ceiling channel.

19. The top assembly of claim 18, wherein the ceiling channel further comprises a pair of spaced apart longitudinal slots defined in the planar portion, and the ceiling bracket further comprises a pair of longitudinal shoulders projecting upwardly from the planar upper surface wherein in the first orientation of the ceiling bracket, the shoulders are received within the slots of the ceiling channel to permit the planar upper surface of the ceiling bracket to abut against the planar portion of the ceiling channel, wherein in the second orientation, the shoulders abut against the planar portion of the ceiling channel, thereby spacing apart the upper surface of the ceiling bracket from the planar portion of the ceiling channel.

20. The top assembly of claim 18, further comprising at east one removable spacer located between the ceiling channel and the ceiling bracket, wherein the spacer is configurable between a first and second position, wherein in the first position of the spacer, the planar portion of the ceiling channel is separated from the planar upper portion of the ceiling bracket by a first vertical distance, wherein in the second position of the spacer, the planar portion of the ceiling channel is separated from the planar upper portion of the ceiling bracket by a second vertical distance wherein the second vertical distance is greater than the first vertical distance.

21. The top assembly of claim 20, wherein the ceiling bracket is in the first orientation when the removable space installed.

22. The top assembly of claim 21, wherein the spacer comprises a first planar surface, a second opposing surface, and a plurality of elongate protrusions extending from the second surface.

23. The top assembly of claim 22, wherein in the first position of the spacer, the planar surface of the spacer abuts against the planar portion of the ceiling channel and the protrusions of the spacer abut against the ceiling bracket, wherein in the second position of the spacer, the planar surface of the spacer abuts against the shoulders of the ceiling bracket, and the protrusions of the spacer abut against the planar portion of the ceiling channel.

24. The top assembly of claim 18, further comprising a clip connected to the ceiling rail, the clip comprising a vertical wall portion adapted to abut against the wall panel.

25. The top assembly of claim 24, further comprising a plurality of the clips arranged in pairs positioned in opposed relation to each other, wherein each pair of clips is adapted to receive the wall panel therebetween.

26. The top assembly of claim 25, further comprising a ceiling trim member adapted for connection to the clip.

27. The top assembly of claim 26, wherein the ceiling trim member comprises a longitudinally extending ridge along the interior surface thereof, wherein the at least one clip comprises a resilient lip adapted to snap the ridge of the ceiling trim member to the clip.

28. The top assembly of claim 27, wherein the clip comprises a plurality of ribs extending from the vertical wall portion of the clip.

29. The top assembly of claim 28, wherein the vertical wall portion of the clip is adapted to contact the wall panel in order to stabilize the wall panel.

30. The top assembly of claim 29, further comprising at least one elbow bracket secured to the ceiling rail, the elbow bracket being located at a joint of the wall panel with an adjacent wall panel, wherein the elbow bracket comprises a vertical portion adapted to abut against the wall panel and the adjacent wall panel.

* * * * *